US005417600A

United States Patent [19]

Maegawa et al.

[11] Patent Number: 5,417,600

[45] Date of Patent: May 23, 1995

[54] METHOD OF MANUFACTURING AN IMPREGNATION TYPE CATHODE

[75] Inventors: Takeyuki Maegawa; Yoshio Takada, both of Hyogo, Japan

[73] Assignee: Mitsubishi Denki Kabushiki Kaisha, Tokyo, Japan

[21] Appl. No.: 7,792

[22] Filed: Jan. 22, 1993

[30] Foreign Application Priority Data

Jan. 22, 1992 [JP] Japan ..... 4-9075

[51] Int. Cl.[6] ..... H01J 9/04

[52] U.S. Cl. ..... 445/51; 445/59; 134/3

[58] Field of Search ..... 445/51, 59; 134/3

[56] References Cited

U.S. PATENT DOCUMENTS

| | | | |
|---|---|---|---|
| 2,199,712 | 5/1940 | Neilson | 134/3 |
| 2,700,000 | 1/1955 | Levi et al. | 252/515 |
| 3,538,570 | 11/1970 | Koppius | 445/51 |
| 3,607,398 | 9/1971 | Lucas | 134/3 |
| 4,007,393 | 2/1977 | van Stratum et al. | 313/346 R |
| 4,406,639 | 9/1983 | Williams | 445/59 |
| 4,410,393 | 10/1983 | Russell et al. | 134/3 |
| 5,236,382 | 8/1993 | Oh | 445/59 |

FOREIGN PATENT DOCUMENTS

| | | | |
|---|---|---|---|
| 2136377 | 2/1972 | Germany | 228/202 |
| 58-26769 | 6/1983 | Japan . | |
| 60-17831 | 1/1985 | Japan . | |

*Primary Examiner*—Kurt Rowan
*Assistant Examiner*—Jeffrey T. Knapp
*Attorney, Agent, or Firm*—Burns, Doane, Swecker & Mathis

[57] ABSTRACT

A manufacturing method of an impregnation type cathode for removing emitter material remaining on the porous sintered body pellets, includes steps for impregnating the emitter material into void spaces between the porous sintered body pellets, heating a phosphoric compound in a vessel up to the temperature in a range of about 100° C. to about 300° C., and dipping the impregnated emitter material into the heated phosphoric compound. The manufacturing method of the present invention creates a cathode which operates stably for a long time with high current density because there is no damage caused when the remaining emitter material is removed from the surface of the porous sintered body pellets.

7 Claims, 1 Drawing Sheet

METHOD OF MANUFACTURING AN IMPREGNATION TYPE CATHODE

BACKGROUND OF THE INVENTION

1. Field of the Invention

The invention relates to a method of manufacturing an impregnation type cathode which can attain an electron emission of a high current density.

2. Description of the Prior Art

In recent years, a high current density, long life time electron gun is required to satisfy demands for high brightness and high resolution of the electron tube. The impregnation type cathode has been widely used in order to satisfy those demands for a high current density and long life time.

The impregnation type cathode is obtained by impregnating an electron emission material (emitter material), comprising mainly, for example, barium, calcium and aluminum, into a porous sintered body pellet metal having a high melting point. This impregnation is generally carried out in a vacuum environment and at a high temperature, and the emitter material is impregnated into void spaces of the porous sintered body. However, not all of the emitter material can be impregnated into the void spaces of the sintered body, and the emitter material which is not impregnated into the void spaces of the sintered body remains on the surface of the sintered body. This remaining emitter material prevents formation of a metal barium mono-atomic layer on the surface of the sintered body, and so generates an unfavorable result in that the emitter characteristics of the electron tube is degraded.

In the past, as described, for example, in Japanese laid-open patent publication No. 60-17831 (1985), in order to remove the remaining emitter material on the surface of the sintered body, many processes have been used, such as mechanical grinding (filing, sand blasting, use of a lapping machine and so on), or cleaning using acid alkali, or ultrasonic cleaning.

According to the conventional method described above, there may arise some problems, for example, the surface of the pellet is marred by many flaws, which are caused by the mechanical grinding and remain on the pellet surface. Also the emission characteristics deteriorates because barium mono-atomic layers are destroyed. Moreover, the pellet size is small, it is very difficult to homogeneously grind the whole surface of the pellet using mechanical grinding, and also mass-production becomes difficult since many pellets can not be ground at the same time. In addition, the emitter material, in general, is subject to attack by moisture, because the barium mono-atomic layer existing on the surface of the emitter material reacts with the moisture, so that the emission decreases at the portions comprised of barium oxide or barium hydroxide. Therefore, it is not desirable to use the above wet cleaning method using water-based solutions such as acid or alkali.

SUMMARY OF THE INVENTION

Accordingly, it is a primary object of the present invention to provide a method of manufacturing an impregnation type cathode which can operate stably for a long time with high current density by removing remaining emitter material from the surface of the porous sintered body pellets without causing a damage thereon.

The method of the invention provides for manufacturing an impregnation type cathode for removing emitter material remaining on porous sintered body pellets, includes steps for impregnating the emitter material into void spaces between the porous sintered body pellets having high melting point, heating phosphoric acid in the vessel up to a predetermined temperature, and dipping the impregnated emitter material into the heated phosphoric acid.

In a preferred embodiment of the present invention, the aforesaid phosphoric acid may be orthophosphoric acid or a phosphoric polymer.

In a preferred embodiment of the present invention, the aforesaid predetermined temperature is from about 100° C. to about 300° C.

In a preferred embodiment of the present invention, the aforesaid phosphoric acid may be diluted by a nonaqueous organic solvent having a high boiling point.

DETAILED DESCRIPTION OF THE PREFERRED EMBODIMENTS

In order to contact the pellet with the etching solution for a short time, it is believed important to use a etching solution which causes a reaction to progress faster and promotes rapid completion of surface grinding. It is also believed important to use a high viscosity etching solution which prevents the solution from easily entering into the void spaces between the porous pellet metal having a high melting point. After many experimental trials, it has been determined that it is most appropriate to use a surface etching solution containing a phosphoric compound in the form of a powder in a nonaqueous solvent. In this case, the phosphoric system formed from a nonaqueous soluble powder has the desired characteristics of high viscosity and less entrained moisture. A suitable phosphoric compound includes orthophosphoric ($H_3PO_4$) acid or its polymer which is heated up to the temperature in the range of from about 100° C. to about 300° C.

When the surface grinding process is carried out under the above conditions, the emitter material remaining on the surface of the porous pellet can be removed (this was verified by XMA (X-ray Micro Analyzer)), and damage caused to the pellet by the grinding solution can be kept at a minimum. Therefore, a high current density impregnation type cathode can be obtained by the present invention.

Embodiment 1

Figure 1:
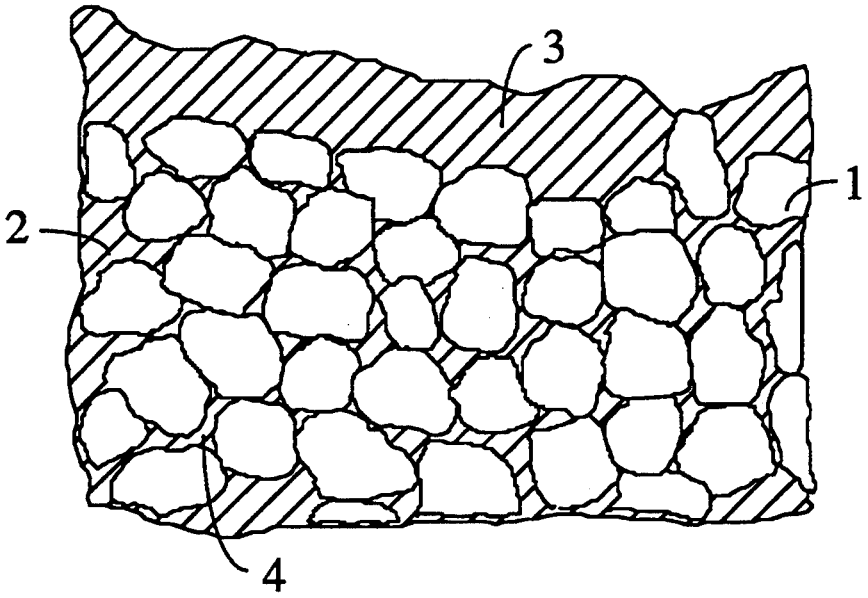
FIG. 1 is an enlarged cross sectional view around a porous sintered pellet of the present invention, before a surface finishing process has been applied.

FIG. 1 is an enlarged cross sectional view around a porous sintered pellet metal of the present invention, having a high melting point which is impregnated by emitter material before a surface finishing process is applied. In FIG. 1, the numeral 1 denotes a porous sintered body obtained by sintering the high melting point metal such as tungsten. The numeral 2 denotes a void space occupied between the porous sintered bodies. The numeral 3 denotes an emitter material such as, for example, a carbonate or an oxide comprised of barium, calcium and aluminum, which is impregnated in the void spaces 2. The impregnation process is usually carried out in a vacuum environment at a temperature from about 1400° C. to about 1700° C. The above impregnation of the emitter material into the void space is well known to a person having skill in the art.

A method for removing the emitter material which remains on the surface of the porous sintered body, after the impregnation process is carried out, is explained hereinafter.

Orthophosphoric acid (reagent quality) is poured into a beaker and heated on a hot plate up to a temperature in the range of about 100° C. to about 300° C., or more desirably up to a temperature in the range of about 200° C. to about 210° C. The orthophosphoric acid may be diluted by a nonaqueous organic solvent having a high boiling point, such as, isopropyl alcohol and butyl alcohol in order to control the etching strength of the orthophosphoric acid. After the solution is heated for an appropriate time, the impregnated cathode pellet is dipped in the heated solution for about ten seconds. This dipping time needs to be adjusted appropriately according to the size or condition of the sample. After the predetermined time during which the impregnated cathode pellet is dipped in the heated solution has passed, the surface of the cathode pellet is fully cleaned by the nonaqueous solvent and the phosphoric acid and is removed. The cathode pellet then is put into an oven heated up to a temperature in the range of about 150° C. to about 200° C., and the surface of the cathode pellet is dried to obtain the impregnation type cathode of an embodiment of the present invention.

Figure 2:
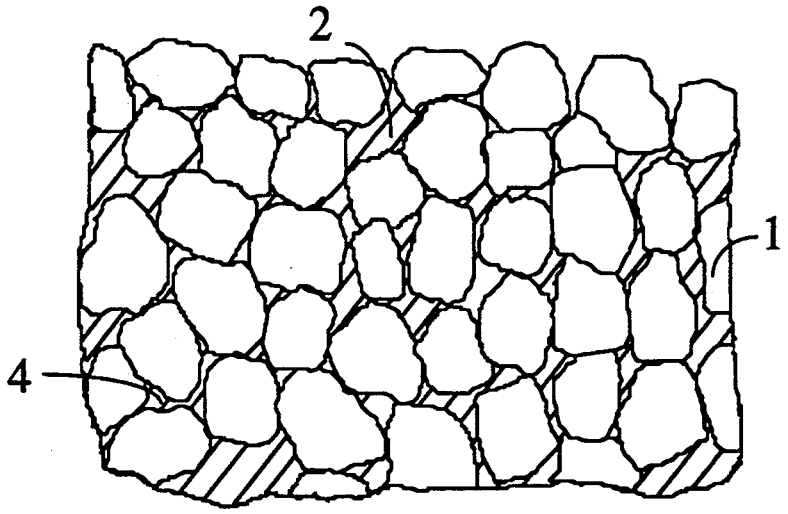
FIG. 2 is an enlarged cross sectional view around a porous sintered pellet of the present invention, after a surface finishing process has been applied.

FIG. 2 is an enlarged cross sectional view around a porous sintered pellet metal according to the invention, having a high melting point, which is impregnated by emitter material after a surface finishing process has taken place. The characteristics of the impregnation type cathode are obtained by applying a high voltage pulse of 10 μs width and 100 Hz repetition rate between an anode electrode and the impregnation type cathode.

Table 1 shows emission characteristics of the cathode pellet.

TABLE 1

| Cathode | Current Density (A/cm2) | | |
|---|---|---|---|
| Temperature | 850° C. Br | 950° C. Br | 1000° C. Br |
| Embodiment 1 | 3.0 | 7.0 | 9.7 |
| Embodiment 2 | 3.2 | 6.8 | 9.2 |
| Comparison Example 1 | <1.0 | 3.0 | 5.0 |

From Table 1, it is easily understood that the first embodiment has a high current density compared with the conventional comparison example 1.

Embodiment 2

In the second embodiment, the cathode pellet is dipped in pyrophosphoric acid ($H_4P_2O_7$) which is the only difference from the embodiment 1 where the cathode pellet is dipped in the orthophosphoric acid. Emission characteristics of the second embodiment are also shown in Table 1. It can be seen that the cathode pellet prepared according to the second embodiment of the invention also displays high current density characteristics.

Comparison Example 1

In the comparison example 1, the surface of the impregnated cathode pellet as described above in the first embodiment is ground using the emery final paper #400, 600 and 1000 to remove the emitter material. The impregnated type cathode obtained by the comparison example 1 is measured by the same method as described in the first embodiment. Its emission characteristics are also shown in Table 1.

Comparison Example 2

In the comparison example 2, the surface of the impregnated cathode pellet as described above in the first embodiment is processed by sand blasting to remove the emitter material. The impregnated type cathode obtained by the comparison example 2 was measured by the same method as described in the first embodiment. Its emission characteristics are substantially the same as the comparison example 1 in Table 1.

Those skilled in the art will recognize that many modifications to the foregoing description can be made without departing from the spirit of the invention. The foregoing description is intended to be exemplary and in no way limiting. The scope of the invention is defined in the appended claims and equivalents thereto.

What is claimed is:

1. A method of manufacturing an impregnation type cathode, comprising the steps of:
   - impregnating an emitter material into void spaces between porous sintered body pellets, the porous sintered body pellets having a high melting point;
   - heating a phosphoric compound up to a predetermined temperature; and
   - dipping the porous sintered body pellets into the heated phosphoric compound to remove emitter material remaining on the porous sintered body pellets,
   - wherein said phosphoric compound is diluted by nonaqueous solvent having a high boiling temperature.

2. A method of manufacturing an impregnation type cathode, comprising the steps of:
   - impregnating an emitter material into void spaces between porous sintered body pellets, the porous sintered body pellets having a high melting point;
   - heating a phosphoric compound up to a predetermined temperature; and
   - dipping the porous sintered body pellets into the heated phosphoric compound to remove emitter material remaining on the porous sintered body pellets,
   - wherein said predetermined temperature is from about 200° C. to about 210° C.

3. A method of manufacturing an impregnation type cathode, comprising the steps of:
   - impregnating an emitter material into void spaces between porous sintered body pellets;
   - heating a high viscosity etching solution consisting essentially of a phosphoric compound in a powder form; and
   - dipping the porous sintered body pellets into the high viscosity etching solution to remove emitter material remaining on the porous sintered body pellets.

4. A method of manufacturing an impregnation type cathode, comprising the steps of:
   - impregnating an emitter material into void spaces between porous sintered body pellets;
   - heating a high viscosity etching solution containing a phosphoric compound in a powder form in a nonaqueous solvent; and
   - dipping the porous sintered body pellets into the high viscosity etching solution to remove emitter material remaining on the porous sintered body pellets.

5. A manufacturing method according to claim 4, wherein phosphoric compound is selected from the group comprising orthophosphoric acid, pyrophosphoric acid, and a phosphoric polymer.

6. A manufacturing method according to claim 4, wherein said predetermined temperature is in the range from about 100° C. to about 300° C. and preferably from about 200° C. to about 210° C.

7. A manufacturing method according to claim 4, further comprising a step for drying a surface of the porous sintered body pellets in an oven at a temperature of about 150° C. to about 200° C.

* * * * *